US006142222A

United States Patent [19]

Kang et al.

[11] Patent Number: 6,142,222

[45] Date of Patent: Nov. 7, 2000

[54] PLATE TUBE TYPE HEAT EXCHANGER HAVING POROUS FINS

[75] Inventors: Byung Ha Kang; Seo Young Kim; Dae Young Lee, all of Seoul; Jin-Ho Kim, Anyang; Hae Seong Ryu, Inchon, all of Rep. of Korea

[73] Assignee: Korea Institute of Science and Technology, Rep. of Korea

[21] Appl. No.: 09/225,582

[22] Filed: Jan. 5, 1999

[30] Foreign Application Priority Data

May 23, 1998 [KR] Rep. of Korea ..... 98-18692

[51] Int. Cl.[7] ..... F28D 1/00

[52] U.S. Cl. ..... 165/148; 165/151; 165/153

[58] Field of Search ..... 165/148, 151, 165/153, 166, 167, 122, 124

[56] References Cited

U.S. PATENT DOCUMENTS

| | | | |
|---|---|---|---|
| 4,046,529 | 9/1977 | Fletchet et al. | 165/166 |
| 4,285,385 | 8/1981 | Hayashi et al. | 164/9 |
| 5,180,001 | 1/1993 | Okada et al. | 165/80.4 |
| 5,211,219 | 5/1993 | Kawabata et al. | 165/183 |
| 5,225,964 | 7/1993 | Nemes | 165/185 |
| 5,727,622 | 3/1998 | Gurevich et al. | 165/80.3 |
| 5,847,927 | 12/1998 | Minning et al. | 165/80.3 |

FOREIGN PATENT DOCUMENTS

| | | | |
|---|---|---|---|
| 935058 | 8/1999 | European Pat. Off. . | |
| 52-134153 | 11/1977 | Japan . | |
| 2-8691 | 1/1990 | Japan | 165/907 |
| 2-93295 | 4/1990 | Japan | 165/907 |
| 2-290664 | 11/1990 | Japan . | |
| 10-292972 | 11/1998 | Japan . | |

OTHER PUBLICATIONS

R.L. Webb, "Principles of Enhanced Heat Transfer", pp. 88, 99, 100 and 139, published by John Wiley & Sons, Inc.

C–C. Wang et al., "An Experimental Study of Heat Transfer and Friction Characteristics of Typical Louver Fin–and–Tube Heat Exchangers", Int. J. Heat Mass Transfer, 41(4–5):817–822 (1998).

Y–J Chang et al., "A Generalized Heat Transfer Correlation for Louver Fin Geometry", Int. J. Heat Mass, 40:533–544 (1997).

T. Hatada et al., "Improved Heat Transfer Performance of Air Coolers by Strip Fins Controlling Air Flow Distribution", ASHRAE Trans., 95:166–170 (1989).

*Primary Examiner*—Ira S. Lazarus
*Assistant Examiner*—Terrell McKinnon
*Attorney, Agent, or Firm*—Ostrolenk, Faber, Gerb & Soffen, LLP

[57] ABSTRACT

A plate tube type heat exchanger using porous fins is manufactured of foamed metal. The porous fins used for the plate tube type heat exchanger are formed of a foamed metal such as aluminum or copper having a high thermal conductivity. The plate tube type heat exchanger using such porous fins exhibits an excellent heat transfer capability, compared to a conventional plate tube type heat exchanger using louvered fins, thereby simplifying production steps and realizing an excellent structural rigidity.

2 Claims, 3 Drawing Sheets

PLATE TUBE TYPE HEAT EXCHANGER HAVING POROUS FINS

BACKGROUND OF THE INVENTION

1. Field of the Invention

The present invention relates to a plate tube type heat exchanger using porous fins manufactured by a foam metal.

2. Description of the Background Art

A heat exchanger is a device performing a heat exchanging between two fluids, for example, a gas and a liquid, or a gas and another gas. The heat exchanger utilizes heat transmission to convert a low temperature fluid into a high temperature fluid and its industrial significance is on the increase in the related industries.

In particular, when heat exchanging is required between a gas and liquid, a heat exchanger using fins at its gas side may be employed so as to decrease a thermal resistance and increase the area exposed to the gas.

Conventional heat exchangers employs a variety of fin configurations including offset fins, wave fins and louvered fins.

An offset fin is formed by staggering adjacent aluminum plates or copper plates to obtain slits therebetween. A wave fin is formed with an undulating wave shape. A louvered fin is formed with angled louvers on a plate and it improves a mixing effect of air passing therethrough and eliminates multistage thermal boundary layers to thereby enhance heat transfer.

Among such fin configurations, the louvered fin is known as providing the best performance. For this reason, the louvered plate type heat exchanger is generally applied to an evaporator, a condenser and a heater core for air conditioning in an automobile requiring a compact type heat exchanger and for releasing heat of engine cooling water.

FIG. 1 illustrates an example of a plate tube type heat exchanger using louvered fins according to the conventional art. As shown therein, the heat exchanger using louvered fins includes a fluid path inlet 1, an inlet tank 2, plate tubes 3, fins 4, a tank 5, an outlet tank 6, and a fluid path outlet 7.

Here, the thermal resistance of the fins 4 through which air passes is the most influential component which decreases the efficiency of heat transmission, and accordingly there have been continuous improvements sought with regard thereto.

However, the conventional plate tube type heat exchanger using louvered fins is manufactured such that a thin aluminum plate of around 0.1 mm in thickness is louvered in multiple stages and continually folded accordingly, thereby complicating its manufacture.

Further, due to its structural weakness, the conventional heat exchanger may be bent when exposed to an impact, and thus there is a demand for a new type heat exchanger having attributes such as a better heat transmission, a structural ruggedness and a simplified manufacturing process.

SUMMARY OF THE INVENTION

The present invention is directed to overcoming the disadvantages of the conventional plate tube type heat exchanger.

Accordingly, it is an object of the present invention to provide a plate tube type heat exchanger using porous fins fabricated by bubbling metal such as aluminum.

In order to achieve the above-described object, a plate tube type heat exchanger according to the present invention is manufactured with porous fins formed of foamed aluminum metal. Such a foamed aluminum metal is characterized by its high porosity, high thermal conductivity and broad surface area, and accordingly if used for fins, the foamed metal significantly decreases air side heat resistance of a heat exchanger for thereby improving the heat transmission characteristics. Compared to louvered fins, the porous fins are easy to manufacture and realizes heightened structural rigidity.

Further, to achieve the above-described object, according to the present invention there are provided porous fins manufactured using foamed metal and a plate tube type heat exchanger using such porous fins. In particular, the present invention relates to an apparatus for exchanging heat between a gas and liquid and between two gases, by use of porous fins made of foamed metal and is applicable, for example, to an evaporator for air conditioning under refrigeration, a condenser and a radiator. The porous fins of the present invention are preferably manufactured using foamed metal having a high heat conductivity so as to decrease an air side heat resistance. Also, to increase an air side thermal transmission area, the porous fins according to the present invention are manufactured using foamed metal with high porosity. The porous fins according to the present invention are formed by processing foamed metal such as melted aluminum and copper which are bubbled using gas. A foamed metal with a thermal conductivity of more than 100 W/mK and a porosity of more than 88% is applicable to the porous fins.

The heat exchanger with porous fins according to the present invention has a large heat transfer area to volume ratio and an irregular fluid path, thereby providing an improved heat transfer effect resulting from fluid mixing.

Additional objects and advantages of the present invention will become more readily apparent from the detailed description given hereinafter. However, it should be understood that the detailed description and specific examples, while indicating preferred embodiments of the invention, are given by way of illustration only, and various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, and wherein.

DETAILED DESCRIPTION OF THE PREFERRED EMBODIMENTS

With reference to the accompanying drawings, the plate tube type heat exchanger with porous fins according to the present invention will now be described.

Figure 1:
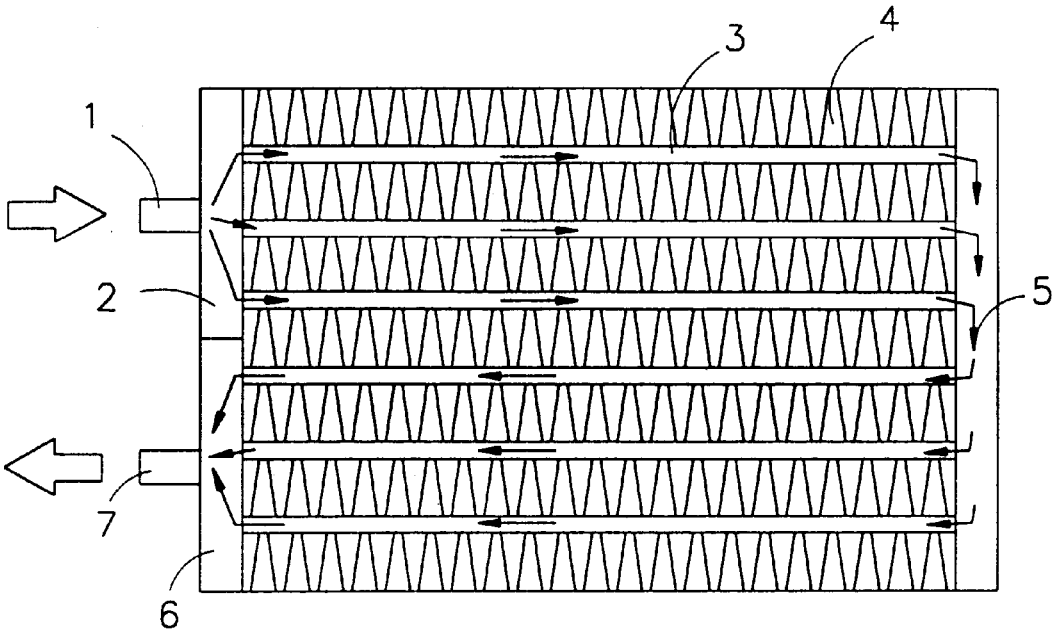
FIG. 1 BACKGROUND ART
FIG. 1 is a schematic view of a conventional plate tube type heat exchanger using louvered fins.
Figure 2:
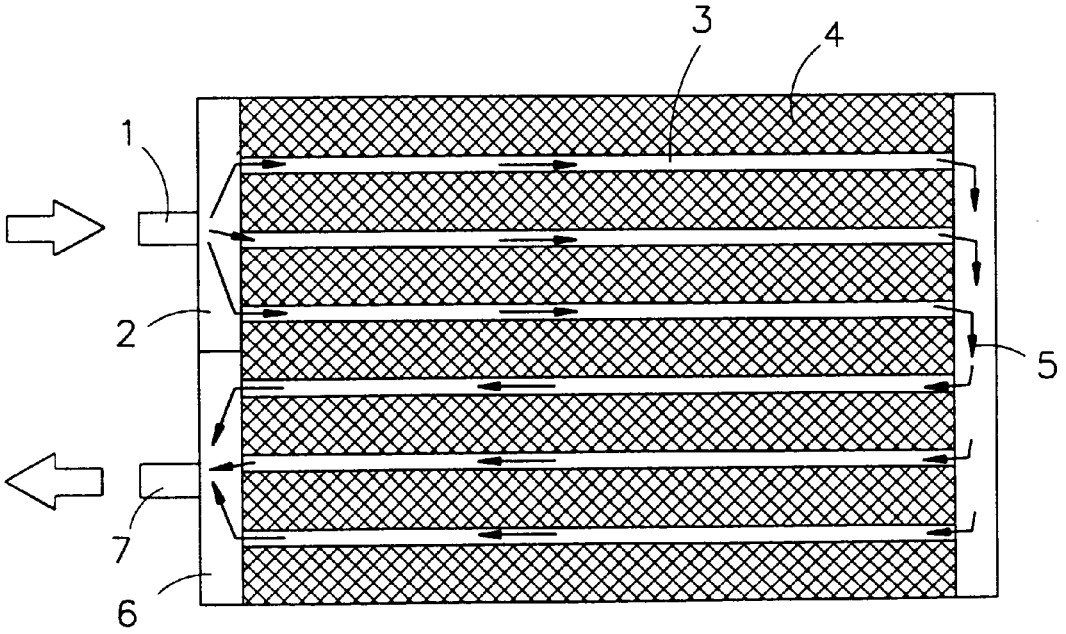
FIG. 2 is a schematic view of a plate tube type heat exchanger with porous fins according to the present invention.

FIG. 2 is a schematic view of a plate tube type heat exchanger according to the present invention. As shown therein, the heat exchanger includes a fluid path inlet 1, an inlet tank 2, plate tubes 3, porous fins 4, a tank 5, an outlet tank 6, and a fluid path outlet 7.

The inflow fluid flows into the fluid path inlet 1 and passes through the inlet tank 2 and thence through those of the plate tubes 3 which are communicated with the inlet tank 2 to thereby carry out heat exchange with a gas which vertically traverses the porous fins 4, then passes through the tank 5 and through those of the plate tubes 3 which are communicated with the outlet tank 6. Then, the fluid comes out of the fluid path outlet 7 via the outlet tank 6.

Figure 3:
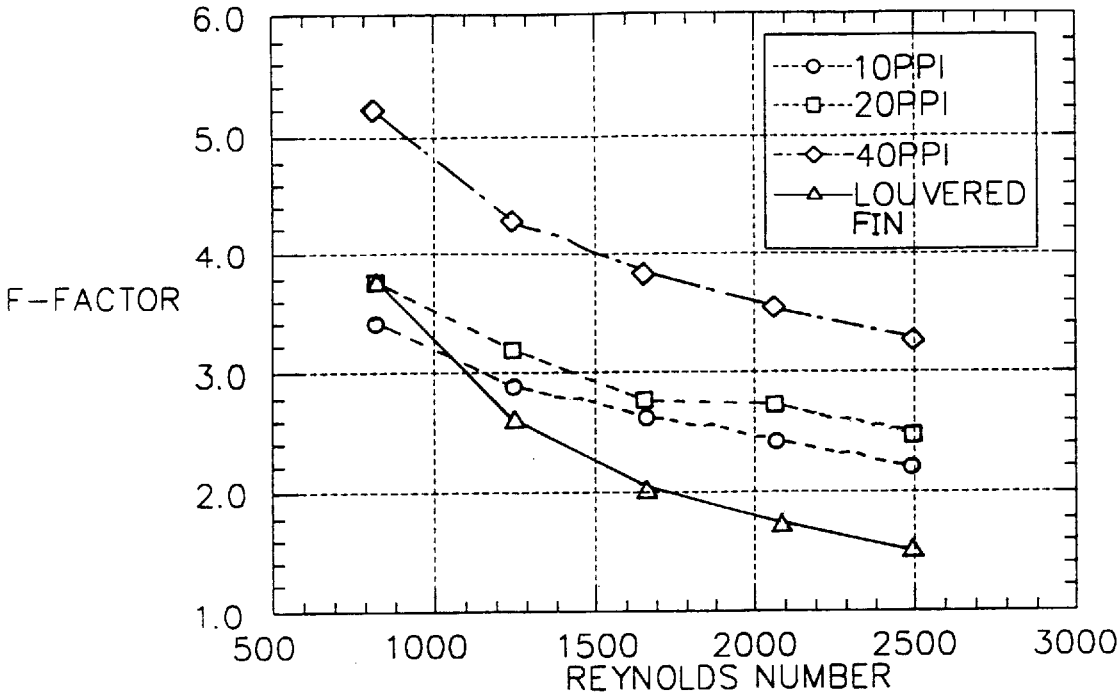
FIG. 3 is a graph comparing pressure drop characteristics of the conventional louvered fins with those of the porous fins according to the present invention, in relation to variations in air flow rate.
Figure 4:
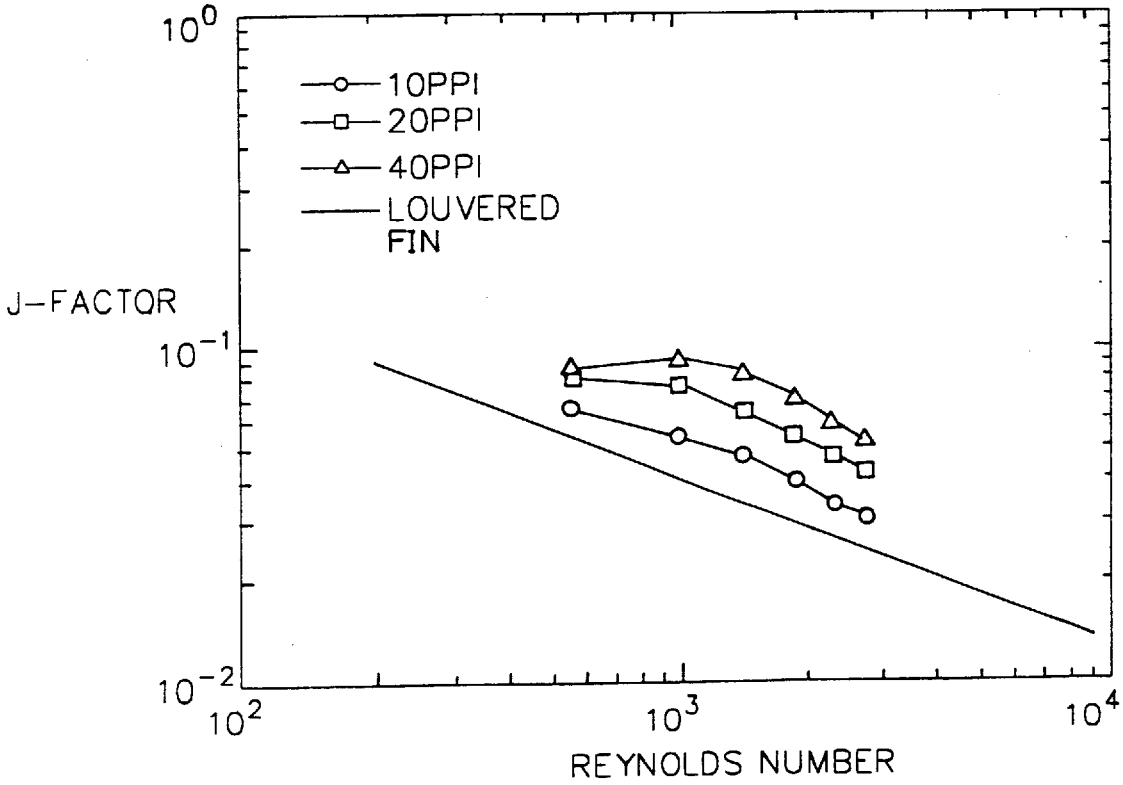
FIG. 4 is a graph comparing heat transfer characteristics of the conventional louvered fins with those of the porous fins according to the present invention, in relation to variations in air flow rate.
Figure 5:
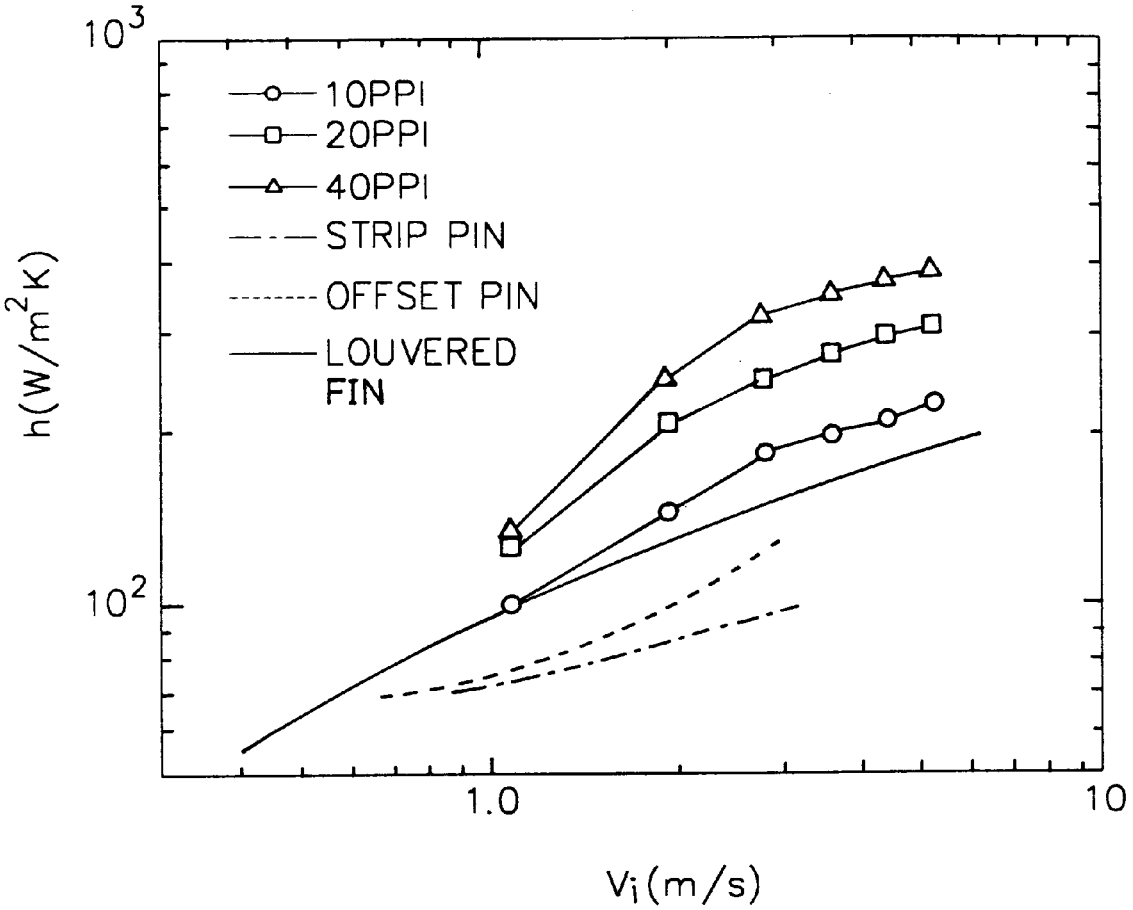
FIG. 5 is a graph comparing heat transfer characteristics of conventional louvered fins, offset fins and strip fins with those of the porous fins according to the present invention, in relation to inlet air velocity.

FIGS. 3 through 5 respectively illustrate compared results of heat transfer capability between a porous plate tube heat exchanger using foamed aluminum metal according to the present invention and a conventional louvered fin plate tube type heat exchanger.

As shown in FIG. 3, there is respectively illustrated the pressure drop according to the air flow rate (Reynolds number) variation for the conventional louvered fins and for three different porous fins varying to 10 ppi, 20 ppi and 40 ppi in pore density using foamed aluminum metal according to the present invention.

Here, in order to understand the pressure drop characteristics of the porous fins, an f-factor is defined as follows:

$$f=(\Delta P/L)\cdot H/(\rho_f V_i^2) \quad (1)$$

where, H and L are respectively the height and length of the fin, $V_i$ denotes an average inlet velocity of the gas, $\rho_f$ denotes density, and $\Delta P$ denotes the pressure drop amount.

From a comparison of the respective pressure drop f-factors of the three different porous fins varying to 10 ppi, 20 ppi, 40 ppi (ppi denotes pores per inch of a porous fin) in pore density under identical flow rates (Reynolds number), it may be understood that the f-factor of a porous fin with a pore density of 10 ppi (pores per inch) is the least in value. That is, the less the permeability, the greater becomes the pressure drop. Compared to the conventional louvered fin, there seems to be a greater pressure drop in the porous fin, disadvantageously. However, such a disadvantage can be sufficiently compensated for by an improved heat transfer characteristics as shown in FIG. 4.

In FIG. 4, there is respectively plotted the air flow rate (Reynolds number) variation of the conventional louvered fin and the porous fin of the present invention, in relation to heat transfer characteristics.

In order to understand the heat transmission characteristics of a porous fin, a j-factor is defined as follows:

$$j=h/(\rho_f C_P V_i)Pr^{2/3} \quad (2)$$

where, $V_i$ denotes the average inlet velocity of the gas, $C_P$ denotes the specific heat of the gas, h denotes the coefficient of convection heat transfer, Pr denotes the Prandtl number of the fluid and equals $\mu C_P/P$, $\mu$ denotes the viscosity coefficient of the gas, and k denotes the thermal conductivity.

The heat transfer characteristic (j-factor) increases significantly proportionally as the pore number per inch (ppi) of a porous fin increases. This is because the heat transmission becomes accelerated due to an abrupt increase of the heat transfer area within the porous fin as the pore density (ppi) increases. As a result, the j-factor of the porous fin is significantly greater when compared to the conventional louvered fin.

FIG. 5 is a graph illustrating the respective convection heat transfer coefficients for estimating the convection heat transfer capability of the conventional louvered fin, offset fin and strip fin, and a porous fin according to the present invention.

As shown therein, the heat transfer capability of a porous fin manufactured foamed metal is better than that of the conventional louvered fin, offset fin and strip fin. Also, the heat transfer capability of a fin with a pore density of 40 ppi proves better than those of pore densities of 10 ppi and 20 ppi. Specifically, FIG. 5 evidences the excellence of the plate tube type heat exchanger using porous fins according to the present invention, whereby there is obtained a convection heat transmission coefficient improvement of 31~120% at most inlet air velocity regions, thereby confirming that heat transfer capability of the plate tube type heat exchanger is much improved when compared to the conventional plate tube type heat exchanger using louvered fins.

The porous fins manufactured using foamed metal in accordance with the present invention are applicable to all heat exchangers utilizing gas and also can be realized by replacing the louvered fins of a conventional heat exchanger with porous fins.

As described above, the plate tube type heat exchanger using porous fins manufactured of foamed metal according to the present invention exhibits a much improved heat transfer capability when compared to the conventional plate tube type heat exchanger using louvered fins, while decreasing its operation cost.

Further, the porous fin application enables a plate tube type heat exchanger to be made smaller for the equivalent heat transfer capability, and the simplified production process thereof offers significantly improved productivity.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claim, and therefore all changes and modifications that fall within meets and bounds of the claim, or equivalences of such meets and bounds are therefore intended to embrace the appended claim.

What is claimed is:

1. In a plate tube heat exchanger provided with a fluid path inlet, an inlet tank, a plate tube, a plurality of fins, a tank, and a fluid path outlet, the improvement wherein the plurality of fins are porous and formed of a foamed metal with a porosity of more than 88%, a pore density of less than 40 ppi, and a thermal conductivity of more than 100 W/mK.

2. The improvement of claim 1, in which the porous metal is selected from the group consisting of aluminum and copper.

* * * * *